United States Patent [19]

Henderson

[11] 4,036,507

[45] July 19, 1977

[54] WHEELS AND ASSEMBLY FOR A BOAT

[76] Inventor: Eldon V. Henderson, Rte. 1, Box 204-H, West Sacramento, Calif. 95691

[21] Appl. No.: 642,253

[22] Filed: Dec. 19, 1975

[51] Int. Cl.[2] ..... B60P 3/10; B63C 1/00

[52] U.S. Cl. ..... 280/414 A; 9/1.2

[58] Field of Search ..... 280/414 A, 763, 767; 9/1.2; 296/23 B; 172/240

[56] References Cited

U.S. PATENT DOCUMENTS

| | | | |
|---|---|---|---|
| 2,227,725 | 1/1941 | Laddon | 9/1.2 X |
| 2,916,747 | 12/1959 | Parrott | 280/414 A |
| 3,134,111 | 5/1964 | Atwood | 280/414 A X |
| 3,146,002 | 8/1964 | Faber | 280/763 |
| 3,499,177 | 3/1970 | Wolfe | 9/1.2 |

*Primary Examiner*—Joseph F. Peters, Jr.
*Assistant Examiner*—R. Schrecengost
*Attorney, Agent, or Firm*—Blair & Brown

[57] ABSTRACT

The wheels and assembly for a boat which is generally of a car top size, the wheels being pivoted so that they can be rotated either into or out of contact with the roadway. The wheels are mounted in an axle bar that is spring-urge located within a channel bracket, so that the axle bar is manually pulled against the spring, rotated, and relocated with a set pin within a notch.

1 Claim, 5 Drawing Figures

FIG. 4.
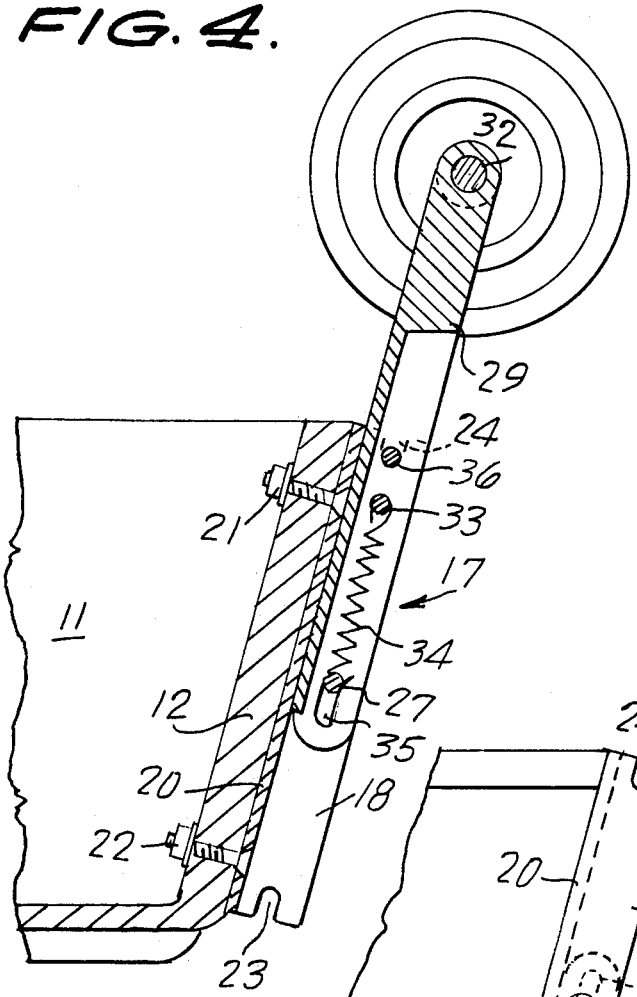
FIG. 3.
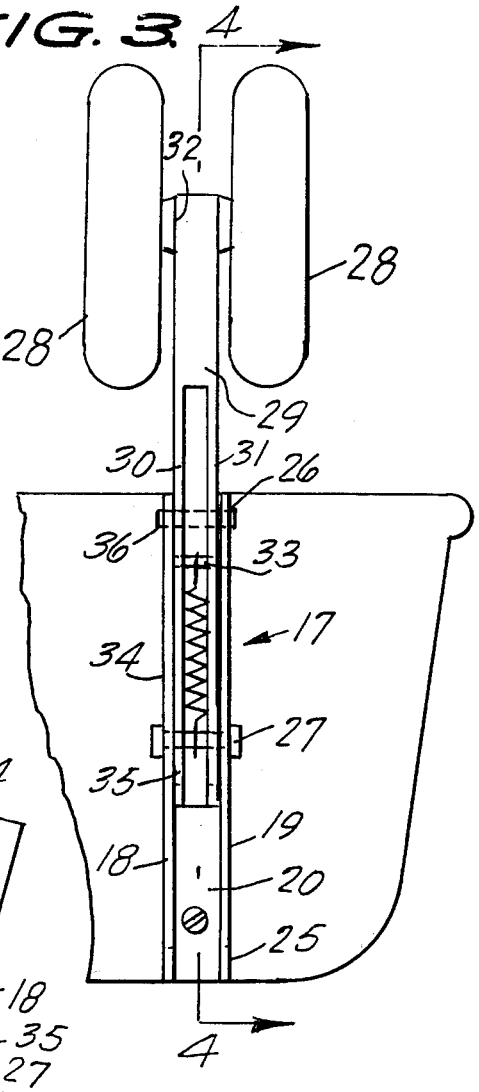
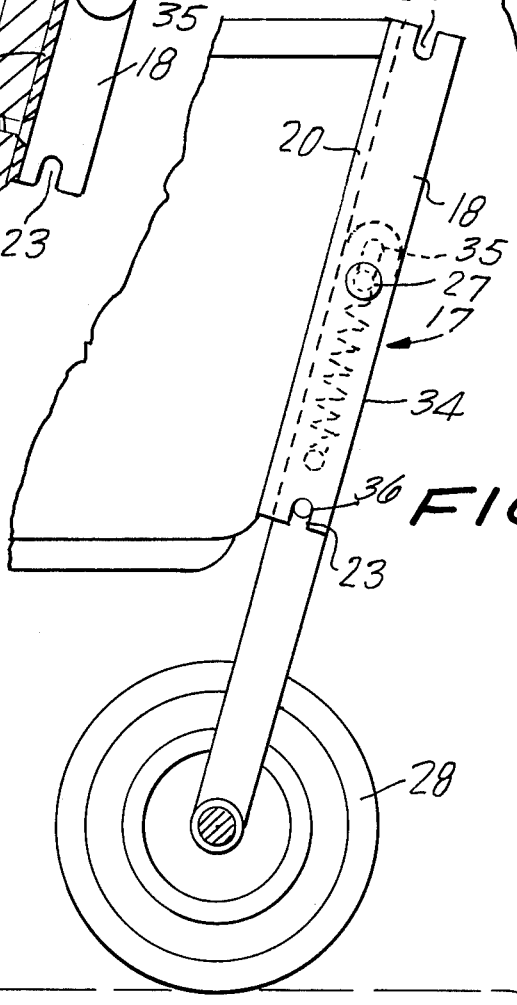
FIG. 5.

WHEELS AND ASSEMBLY FOR A BOAT

BACKGROUND OF THE INVENTION

1. Field of the Invention

The present invention relates to wheels for car top sized, light weight boats.

2. Summary of the Invention

The present invention for a set of wheels that may be attached to the rear of a row boat comprises an assembly for supporting the wheels and which is bolted to the stern of the boat. The assembly takes the form of a channel constructed of two parallel plates with an axle bar pivotally mounted between the plates to hold and support the wheels themselves. At each end of the channel there is a notch cut into the plates while the axle bar has a pin extending crosswise of the bar for insertion into either of the notches to lock the bar and wheels in place. An elongated slot for the mounting pin, and a spring, provide the axle bar with sufficient play to move into and out of the notches.

The primary object of the invention is to provide a set of adjustable wheels and assembly for a reasonably sized, car top sized, aluminum boat, wherein the wheels may be positioned for contact with the road, or folded up out of use.

Other objects and advantages will become apparent in the following specification when considered in light of the attached drawings.

BRIEF DESCRIPTION OF THE DRAWINGS

FIG. 3 is a sectional view taken along line 3—3 of FIG. 2 looking in the direction of the arrows;

FIG. 4 is a sectional view taken along the line 4—4 of FIG. 3, looking in the direction of the arrows; and FIG. 5 is a sectional view of the stern of a boat with the wheels locked in contact with the roadway.

DESCRIPTION OF THE PREFERRED EMBODIMENT

Figure 1:
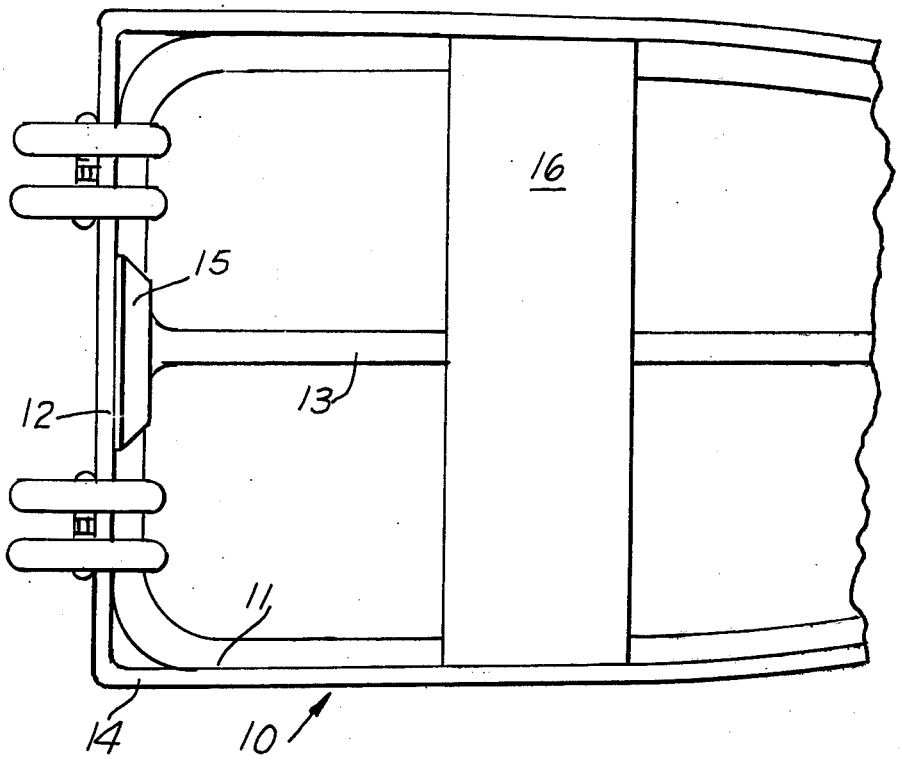
FIG. 1 is a top plan view of the boat with a double set of wheels in place.
Figure 2:
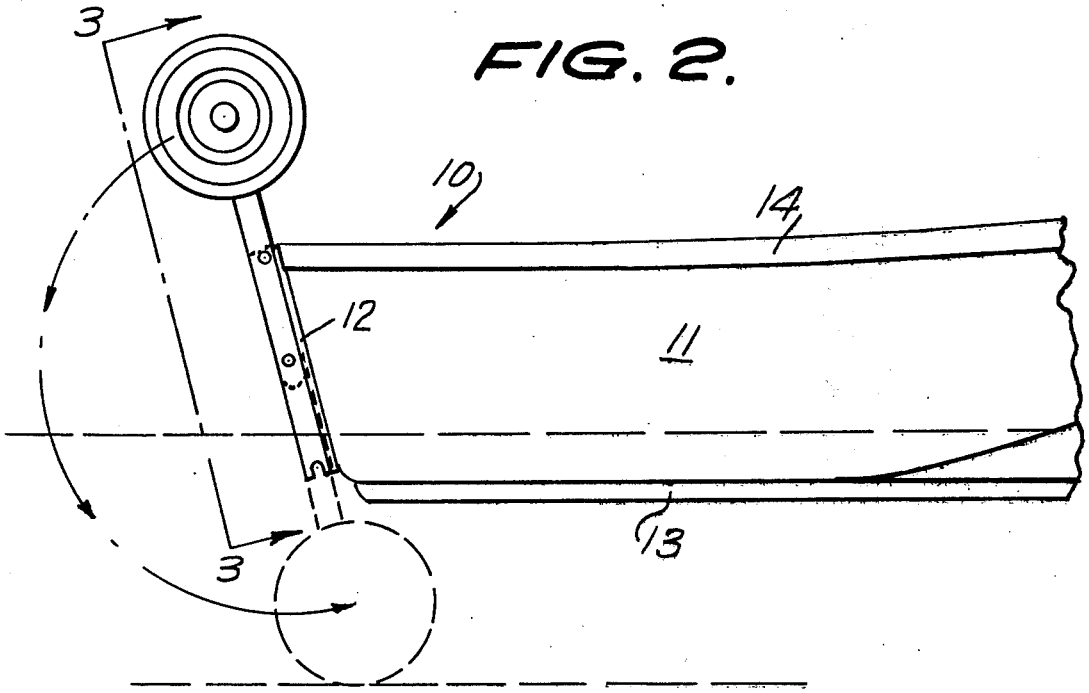
FIG. 2 is a side elevation of the boat with its wheels folded upward.

Referring now to the drawings in detail, wherein like reference characters indicate like parts throughout the several figures, the reference numeral 10 indicates generally a boat incorporating the wheels and assembly of the present invention.

The boat indicated generally by the numeral 10 may be basically of the row boat size, and particularly in the area of a car top, or trailer top size and made of light weight material such as aluminum. Frequently boats are carried strapped on top of cars, trailers, and the like, for transport between lakes and rivers, but once at their destination there may be difficulty in moving the boat from the car to the lake. This need gives rise for the application of wheels to the boat frame.

The boat 10 may be composed of sides 11 and a stern 12, all of which are held in place by means of a keel 13. A top railing 14 surrounds the sides 11 and stern 12. In FIG. 1 a portion of the keel 13, which spreads out to lend support to stern 12, is shown as 15. A transverse board, or seat 16, may extend crosswise of the area of the boat and be attached to sides 11 in a conventional manner.

There is a U-shaped channel shown generally as 17, which is composed of side members 18 and 19 located along the edges of a base member 20. The base member 20 is placed flat against the stern 12 of the boat 10 and is firmly secured to the stern 12 by means of bolts 21 and 22, shown best in FIG. 4. The heads of bolts 21 and 22 are countersunk flush into base 20, and the side members 18 and 19 extend outward from the stern 12. At one end of side member 18 there is cut a notch 23 a short distance along the member, while at the opposite end of side member 18 there is a similar notch 24; correspondingly there are notches 25 and 26 cut into the ends of side member 19.

About midway along the length of side members 18 and 19, and positioned transversely through them there is fastened a bolt 27, the purpose of which will be described hereinafter.

Cooperating with the U-shaped member 17, and forming a support for the wheels 28, there is an elongated wheel support bar 29. From FIG. 3 it may be observed that the support bar is substantially in the shape of a Y, with a solid end portion 29 and two separated arms 30 and 31, the solid portion 29 having a cross axle 32 for mounting a pair of inflated wheels 28. Furthermore, it should be observed that the two separated arms are spread a distance slightly less than that between side members 18 and 19 of U-shaped member 17 so that the support bar can freely move in member 17.

Fixed across arms 30 and 31 there is a cross pin 33 joining these arms, and serving as one of the end anchors for a coil spring 34. This coil spring 34 is located between the side arms 30 and 31 and has its opposite end fastened to pivot bolt 27.

In FIG. 4, which is a side elevation view of the wheel assembly, it can be clearly seen that the extreme ends of arms 30 and 31 are provided with an elongated slot 35, located in the center of which is the fixed pivot bolt 27, this construction permitting movement of support bar 29 for a distance equal to the length of slot 35 when the bar 29 is pulled against th action of spring 34. Mounted across arms 30 and 31 there is permanently affixed a metal pin 36.

Turning back briefly to FIG. 1 it may be noted, in that view, that two sets of wheels have been attached to the stern of boat 10, rather than a single set. While it is recommended that the boats involved in the present invention be of a size adaptable for loading atop a car or trailer, there still can be some variance in their sizes so there can be one or two sets of wheels employed, as desired.

In operation of the invention, the wheels 28 may be stored in an upward position, out of contact with the roadway, as shown in FIGS. 3 and 4. When it is desired to put them down on the road, support bar 29 is grasped and pulled upward, against the action of spring 34, until pin 36 is clear of notches 24 and 26. Once this is done the wheel assembly is then rotated downward for 180 degrees, the assembly pivoting about bolt 27. When the wheels are fully down, as seen in FIG. 5, the assembly is locked in place by pushing upward slightly until pin 36 has now entered notches 23 and 25, to lock the assembly in place.

Having thus described the preferred embodiment of the invention it should be understood that numerous structural modifications and adaptations may be resorted to without departing from the spirit of the invention.

What is claimed is:

1. A wheel assembly for a boat comprising a substantially U-shaped framework for vertical attachment to the stern of a boat, a substantially Y-shaped support bar having a pair of spaced apart arms fitted inside said U-shaped framework and slidably mounted for movement along the framework and a leg extending from said arms, a plurality of wheels mounted on the outer end of the leg of the support bar, a pivot means extending through said U-shaped framework and through elongate slots in the ends of said arms, said arms pivotally mounting said support bar to said framework with said slots permitting the support bar to move along said framework, means for locking the support bar and framework together including a transverse pin across the arms of the support bar and a plurality of notches in the ends of the U-shaped framework, said notches being adapted to lockingly receive the transverse pin after the support bar moves and thereby hold the wheels in contact with the road or upwardly in the air, and a spring between the support bar and the U-shaped framework for resiliently separating the bar and the framework a distance equal to the elongated slots to thereby assist in inserting the pin in the notches.

* * * * *